US011608579B2

(12) United States Patent
Rodriguez et al.

(10) Patent No.: US 11,608,579 B2
(45) Date of Patent: Mar. 21, 2023

(54) MULTIPLE LOAD LAUNDRY APPLIANCE COMMUNICATION

(71) Applicant: Haier US Appliance Solutions, Inc., Wilmington, DE (US)

(72) Inventors: Jose Efren Rodriguez, Louisville, KY (US); Ryan James Scheckelhoff, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 232 days.

(21) Appl. No.: 17/098,715

(22) Filed: Nov. 16, 2020

(65) Prior Publication Data

US 2022/0154379 A1 May 19, 2022

(51) Int. Cl.

| | |
|---|---|
| ***D06F 34/04*** | (2020.01) |
| ***D06F 34/28*** | (2020.01) |
| ***D06F 58/38*** | (2020.01) |
| *D06F 103/38* | (2020.01) |
| *D06F 103/04* | (2020.01) |
| *D06F 103/06* | (2020.01) |

(52) U.S. Cl.

CPC ..... *D06F 34/04* (2020.02); *D06F 34/28* (2020.02); *D06F 58/38* (2020.02); *D06F 2103/04* (2020.02); *D06F 2103/06* (2020.02); *D06F 2103/38* (2020.02)

(58) Field of Classification Search

CPC ..... D06F 34/04

See application file for complete search history.

(56) References Cited

U.S. PATENT DOCUMENTS

| | | | |
|---|---|---|---|
| 10,423,869 | B1 | 9/2019 | Root |
| 2003/0115682 | A1 | 6/2003 | Gardner |
| 2017/0183811 | A1 | 6/2017 | Kang |
| 2019/0257021 | A1 | 8/2019 | Ahn |

FOREIGN PATENT DOCUMENTS

| | | | |
|---|---|---|---|
| KR | 101850717 | B1 | 4/2018 |

*Primary Examiner* — Jason Y Ko

(74) *Attorney, Agent, or Firm* — Dority & Manning, P.A.

(57) ABSTRACT

A laundry system may include a washing machine appliance and a dryer appliance. The washing machine appliance may include a first controller configured to initiate a washing operation. The first controller may be configured store wash control information of a plurality of discrete washing operation occurrences of the washing machine appliance. The dryer appliance may include a second controller in operable communication with the first controller to receive one or more data signals therefrom. The second controller may be configured to initiate a drying operation. The first controller or the second controller may be configured to determine a combined load condition based on the wash control information of the plurality of discrete washing operation occurrences of the washing machine appliance. The second controller may be configured to adjust the drying operation according to the combined load condition.

19 Claims, 3 Drawing Sheets

FIG. —1—

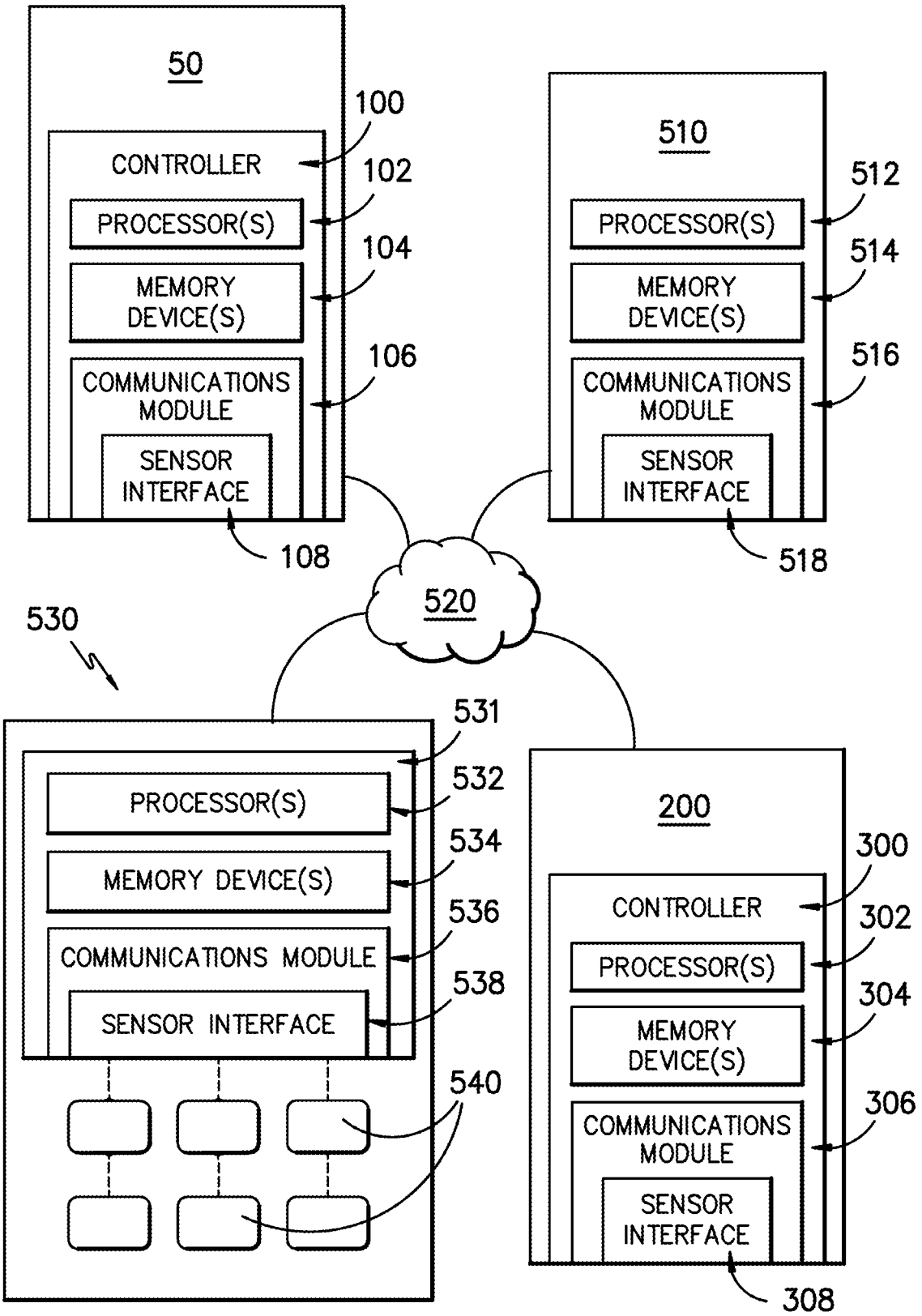
*FIG. —3—*

MULTIPLE LOAD LAUNDRY APPLIANCE COMMUNICATION

FIELD OF THE INVENTION

The present subject matter relates generally to laundry appliances, and more particularly to communicating information regarding multiple loads or operations.

BACKGROUND OF THE INVENTION

Washing machine appliances and dryer appliances are frequently used to clean and dry various articles, such as clothes, linens, etc. Washing machine appliances generally include a tub for containing wash fluid (e.g., water and detergent, bleach or other wash additives). A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc. After washing in a washing machine appliance, articles are typically transferred to a dryer appliance. Dryer appliances generally include a cabinet with a drum mounted therein. Dryer appliances also generally include a heater assembly that passes heated air through the chamber of the drum in order to dry moisture laden articles disposed within the chamber.

Typical washing machine appliances and dryer appliances are stand-alone appliances, with no apparatus for communicating with one another. Accordingly, a user must manually input the desired washing operation and various options into the washing machine appliance, and separately manually input the desired dry operation and various options into the dryer appliance. This can be a time-consuming and irritating task for the consumer.

More recently, apparatus for facilitating communication between washing machine appliances and dryer appliances have been developed. Typically, a hardwired connection has been provided between the controllers of a washing machine appliance and a dryer appliance. Through the connection, information about a single wash cycle is communicated to the dryer appliance.

Although existing connected appliances may be useful when a single load of articles (e.g., washing load) is moved immediately from the washing machine appliance to the dryer appliance for drying. Nonetheless, this is incongruent with how many consumers use their laundry appliances. For instance, many consumers prefer to dry multiple washing loads together in a single drying load. The single drying load may, thus, include many different types of articles and be of a significantly larger size (e.g., mass, volume, etc.) than any one washing load. Additionally or alternatively, large stretches of time may pass between when a washing load has finished (i.e., the end of the corresponding wash cycle) and when a drying load begins (i.e., the start of the corresponding drying load). Generally, these changes cannot be communicated between laundry appliances (e.g., from a washing machine appliance to a dryer appliance). Moreover, a user is required to guess as to how these changes will affect the preferable dryer settings.

Accordingly, improved cleaning systems and associated methods are desired. In particular, cleaning systems and methods which provide improved communication and adaption to multiple cycles would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry system is provided. The laundry system may include a washing machine appliance and a dryer appliance. The washing machine appliance may include a first controller configured to initiate a washing operation. The first controller may be configured store wash control information of a plurality of discrete washing operation occurrences of the washing machine appliance. The dryer appliance may include a second controller in operable communication with the first controller to receive one or more data signals therefrom. The second controller may be configured to initiate a drying operation. The first controller or the second controller may be configured to determine a combined load condition based on the wash control information of the plurality of discrete washing operation occurrences of the washing machine appliance. The second controller may be configured to adjust the drying operation according to the combined load condition.

In another exemplary aspect of the present disclosure, a laundry system is provided. The laundry system may include a washing machine appliance and a dryer appliance. The washing machine appliance may include a first controller configured to initiate a washing operation. The first controller may be configured store wash control information of a plurality of discrete washing operation occurrences of the washing machine appliance. The wash control information may include a wash cycle or an article load type of each washing operation occurrence of the plurality of discrete washing operation occurrences. The dryer appliance may include a second controller in operable communication with the first controller to receive one or more data signals therefrom. The second controller may be configured to initiate a drying operation. The first controller or the second controller may be configured to determine a combined load condition based on the wash control information of the plurality of discrete washing operation occurrences of the washing machine appliance. The combined load condition may include a combined mass of the plurality of discrete washing operation occurrences. The second controller may be configured to adjust the drying operation according to the combined load condition.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 3 is a schematic diagram of a laundry system with an exemplary embodiment of the present disclosure.

DETAILED DESCRIPTION

Figure 1:
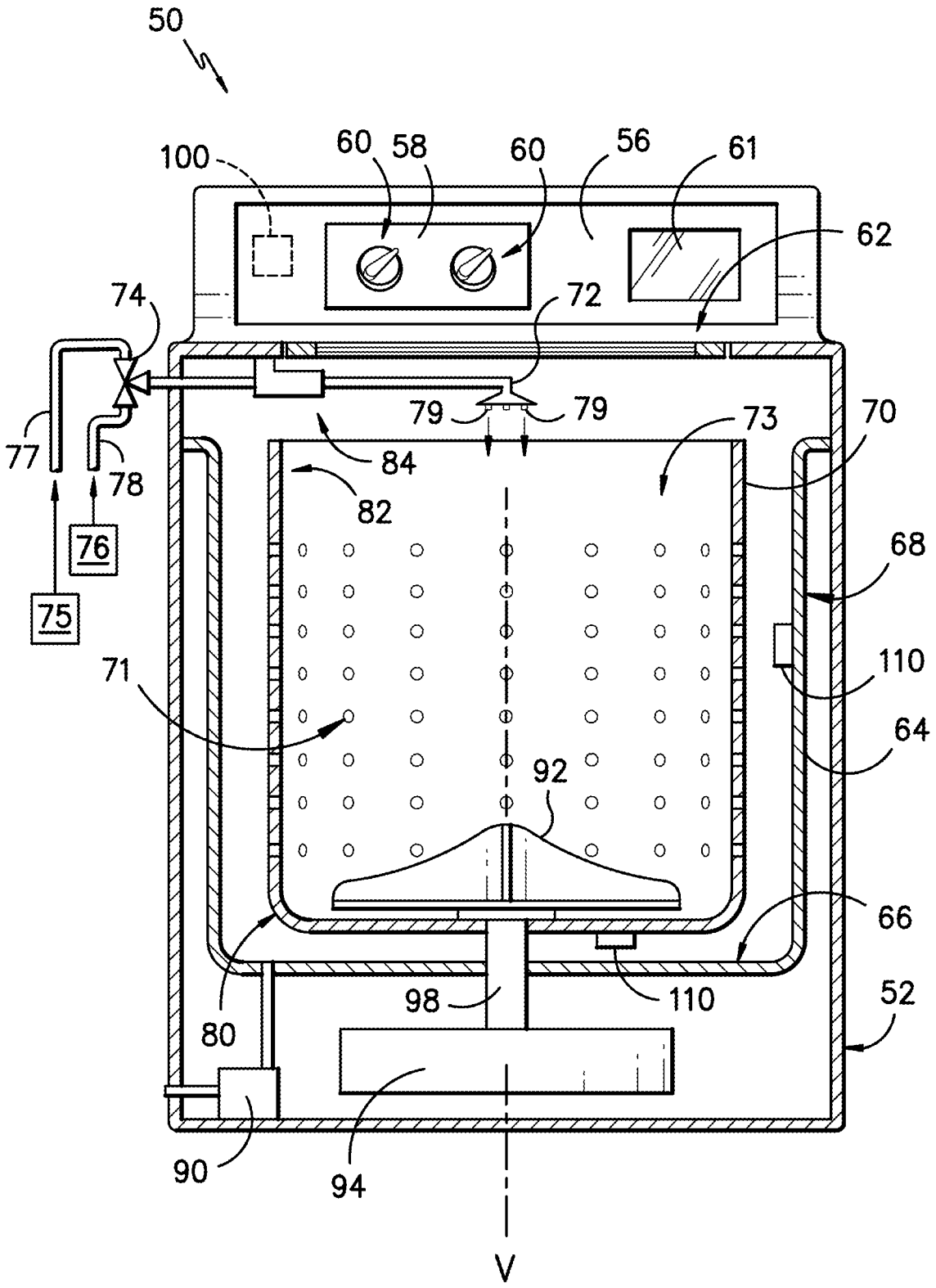
FIG. 1 is a front, cross-sectional, elevation view of a washing machine appliance in accordance with an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

It is noted that, for the purposes of the present disclosure, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
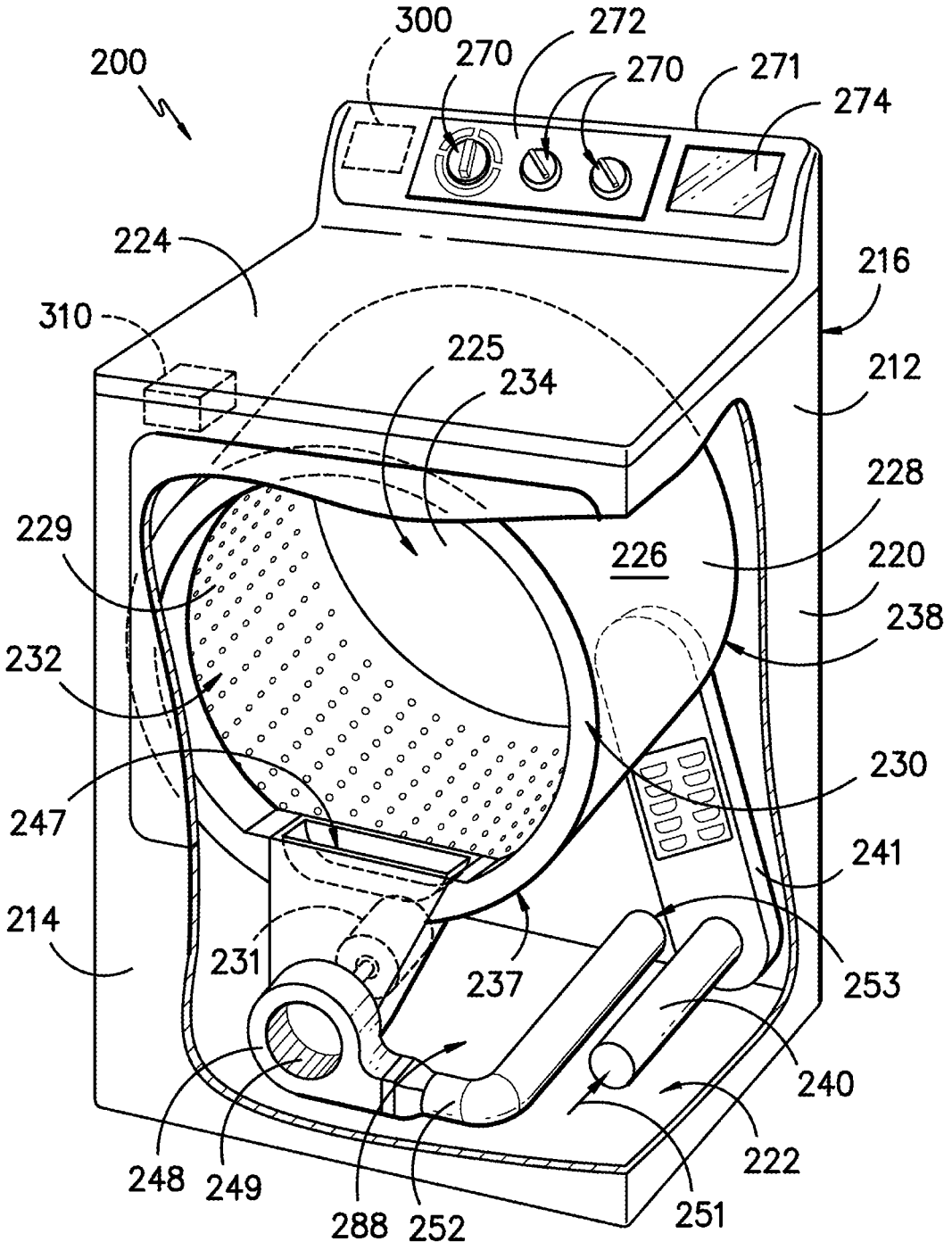
FIG. 2 is a front, cross-sectional, perspective view of a dryer appliance in accordance with an exemplary embodiment of the present disclosure.

Turning now to the figures, FIG. 1 is a front, cross-sectional, elevation view of a washing machine appliance 50 in accordance with an exemplary embodiment of the present disclosure. FIG. 2 is a front, cross-sectional, perspective view of a dryer appliance 200 in accordance with an additional or alternative exemplary embodiment of the present disclosure. FIG. 3 is a schematic view of a laundry system 500 in accordance with a further additional or alternative exemplary embodiment of the present disclosure.

As may be seen in FIG. 1, washing machine appliance 50 includes a cabinet 52 and a cover 54. In optional embodiments, a backsplash 56 extends from cover 54, and a control panel 58 including an input selector 60 (e.g., a single button, knob, or switch) is coupled to backsplash 56. Control panel 58 and input selector 60 collectively form at least a portion of a user interface for operator (i.e., user) selection of machine cycles and features. In additional or alternative embodiments, a display 61 indicates selected features, a countdown timer, or other items of interest to machine users. A lid 62 is mounted to cover 54 and is rotatable between an open position facilitating access to a wash tub 64 located within cabinet 52 and a closed position forming an enclosure over tub 64.

Tub 64 includes a bottom wall 66 and a sidewall 68. A wash drum or wash basket 70 is rotatably mounted within tub 64. In particular, basket 70 is rotatable about a vertical axis V. Thus, washing machine appliance 50 is generally referred to as a vertical axis washing machine appliance. Basket 70 defines a wash chamber 73 for receipt of articles for washing and extends (e.g., vertically) between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 75, 76 in order to direct liquid (e.g. water) into tub 64 or onto articles within chamber 73 of basket 70. Nozzle 72 may further include apertures 79 through which water may be sprayed into the tub 64. Apertures 79 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e., sprayed or poured) into the tub 64.

In some embodiments, a main valve 74 regulates the flow of fluid through nozzle 72. For example, valve 74 can selectively adjust to a closed position in order to terminate or obstruct the flow of fluid through nozzle 72. The main valve 74 may be in fluid communication with one or more external water sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the main valve 74. A cold water conduit 77 and a hot water conduit 78 may supply cold and hot water, respectively, from the sources 75, 76 through valve 74. Valve 74 may further be operable for configured to regulate the flow of hot and cold liquid, and thus the temperature of the resulting liquid flowed into tub 64, such as through the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIG. 1) is located beneath tub 64 and basket 70 for gravity assisted flow to drain tub 64.

An agitation element 92, shown as an impeller in FIG. 1, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 1, agitation element 92 is oriented to rotate about vertical axis V. Basket 70 and agitation element 92 are driven by a motor 94, such as a pancake motor. As motor output shaft 98 is rotated, basket 70 and agitation element 92 are operated for rotatable movement within tub 64 (e.g., about vertical axis V). Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 100. Generally, controller 100 is operatively coupled input selector 60 located on washing machine backsplash 56 for user manipulation to initiate washing machine cycles and features. Controller 100 may further be operatively coupled to various other components of appliance 50, such as main valve 74, motor 94, etc. In response to user manipulation of the input selectors 60, controller 100 may operate the various components of washing machine appliance 50 to execute selected machine cycles and features (e.g., as or as part of a washing operation).

In some embodiments, inputs or instructions for the cleaning cycle can be supplied or influenced by the selections made by a user at (i.e., user manipulation of) input selectors 60. For instance, users may provide data or information, such as wash control information relating to a desired washing operation (e.g., cleaning cycle) for a particular washing operation occurrence. Additionally or alternatively, one or more sensors may detect wash control information for a particular washing operation occurrence.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Control panel 58 and other components of washing machine appliance 50 may be in communication with controller 100 via one or more signal lines or shared communication busses.

In optional embodiments, one or more sensors 110 are included within washing machine appliance 50. Sensors 110 may be mass sensors, speed sensors, or other suitable sensors in operable communication with (e.g., electrically or wirelessly coupled to) controller 100 and used in the washing machine appliance to obtain performance data for the washing machine appliance 50.

In an illustrative embodiment, laundry items or articles are loaded into chamber 73 of basket 70 (e.g., as a single washing load), and washing operation is initiated through operator manipulation of control input selectors 60. Tub 64 is filled with water and mixed with detergent to form a liquid or wash fluid. Main valve 74 can be opened to initiate a flow of water into tub 64 via nozzle 72, and tub 64 can be filled to the appropriate level for the amount of articles being washed. Once tub 64 is properly filled with wash fluid, the contents of the basket 70 are agitated with agitation element 92 for cleaning of articles in basket 70. More specifically, agitation element 92 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 may again provide agitation within basket 70. One or more spin cycles may also be used. In particular, a spin cycle may be applied after the wash cycle or after the rinse cycle in order to wring wash fluid from the articles being washed. During a spin cycle, basket 70 is rotated at relatively high speeds.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, or different features may also be used with the present subject matter as well.

Turning particularly to FIG. 2, a dryer appliance 200 is illustrated with a portion of a cabinet or housing 212 of dryer appliance 200 removed in order to show certain components of dryer appliance 200. While described in the context of a specific embodiment of dryer appliance 200, using the teachings disclosed herein it will be understood that dryer appliance 200 is provided by way of example only. Other dryer appliances having different appearances and different features may also be used with the present subject matter as well.

In some embodiments, the cabinet 212 includes a front panel 214, a rear panel 216, a pair of side panels 218 and 220 spaced apart from each other by front and rear panels 214 and 216, a bottom panel 222, and a top cover 224. Within the cabinet 212 is a fixedly mounted drum or container 226. Drum 226 is fixed within the cabinet 212, such that it is generally stationary and non-rotational during dryer appliance 200 operation. Drum 226 defines a chamber 225 for receipt of articles (e.g., clothing, linen, etc.) for drying. Drum 226 extends between a front portion 237 and a back portion 238 (e.g., along a lateral direction).

Drum 226 is generally cylindrical in shape, having an outer cylindrical wall or cylinder 228 and a front flange or wall 230 that may define an entry 232 of drum 226 (e.g., at front portion 237 of drum 226) for loading and unloading of articles into and out of chamber 225 of drum 226. Cylinder 228 may include a generally cylindrical inner surface 229. Drum 226 also includes a back or rear wall 234 (e.g., at back portion 238 of drum 226). Notably, in alternative embodiments, entry 232 may be defined in top cover 224 and cylinder 228, and front wall 230 may be a generally solid wall.

A motor 231 may be in mechanical communication with an air handler 248 such that motor 231 rotates a fan 249 (e.g., a centrifugal fan) of air handler 248. Air handler 248 is configured for drawing air through chamber 225 of drum 226 (e.g., during a laundry cycle in order to dry articles located therein as discussed in greater detail below). In alternative exemplary embodiments, dryer appliance 200 may include an additional motor (not shown) for rotating fan 249 of air handler 248 independently of drum 226.

Drum 226 may be configured to receive heated air that has been heated by a heating assembly 240 (e.g., during a laundry cycle in order to dry damp articles disposed within chamber 225 of drum 226). Heating assembly 240 includes a heating element (not shown), such as a gas burner or an electrical resistance heating element, for heating air. As discussed above, during operation (e.g., for a laundry cycle) of dryer appliance 200, motor 231 rotates fan 249 of air handler 248 such that air handler 248 draws air through chamber 225 of drum 226. In particular, ambient air enters heating assembly 240 via an entrance 251 due to air handler 248 urging such ambient air into entrance 251. Such ambient air is heated within heating assembly 240 and exits heating assembly 240 as heated air. Air handler 248 draws such heated air through duct 241 to drum 226. The heated air enters drum 226 through an outlet of duct 241 positioned at rear wall 234 of drum 226.

Within chamber 225, the heated air can remove moisture (e.g., from damp articles disposed within chamber 225). In turn, air handler 248 draws moisture statured air through a screen filter 246 which traps lint particles. Such moisture statured air then enters an exit conduit 247 and is passed through air handler 248 to an exhaust conduit 252. From exhaust conduit 252, such moisture statured air passes out of dryer appliance 200 through a vent 253 defined by cabinet 212. After the clothing articles have been dried, they are removed from the drum 226 via entry 232. A door 233 provides for closing or accessing drum 226 through entry 232.

A backsplash 271 extends from cabinet 212, and a control panel 272 including an input selector 270 (e.g., a single button, knob, or switch) is coupled to the backsplash 271. Control panel 272 and input selector 270 collectively form a user interface for operator (i.e., user) selection of machine cycles and features, and in one embodiment, a display 274 indicates selected features, a countdown timer, or other items of interest to machine users.

Operation of dryer appliance 200 is controlled by a processing device or controller 300 that is operatively coupled to the input selectors 270 located on backsplash 271 for user manipulation to select dryer cycles and features. Controller 300 may further be operatively coupled to various other components of appliance 200, such as motor 231, etc. In response to user manipulation of the input selectors 270, controller 300 may operate the various components of dryer appliance 200 to execute selected machine cycles and features (e.g., as or as part of a drying operation).

Controller 300 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 300 may be constructed without using a microprocessor (e.g., using a combination of discrete analog or digital logic circuitry; such as switches, amplifiers, integrators, comparators, flip-flops, AND gates, and the like) to perform control functionality instead of relying upon software. Control panel 272 and other components of dryer appliance 200 may be in communication with controller 300 via one or more signal lines or shared communication busses.

It should be understood that, while FIG. 2 illustrates an embodiment wherein dryer assembly 200 is a horizontal axis dryer assembly, in other embodiments dryer assembly 200 may be, for example, a vertical axis dryer assembly or another suitable dryer assembly. Accordingly, the present disclosure is not limited to horizontal axis dryer assemblies. Rather, any suitable dryer assembly is within the scope and spirit of the present disclosure.

Referring now to FIG. 3, a cleaning system 500 in accordance with one embodiment of the present disclosure is provided. Cleaning system 500 includes a washing machine appliance 50 and a dryer appliance 200. The washing machine appliance 50 includes a first controller 100, while the dryer appliance 200 includes a second controller 300. Various components of the respective controllers 100, 300 are illustrated in schematic fashion. As shown, a controller 100, 300 may include one or more processor(s) 102, 302 and associated memory device(s) 104, 304 configured to perform a variety of computer-implemented functions (e.g., performing methods, steps, and the like). Additionally, the controller 100, 300 may also include a communications module 106, 306 to facilitate communications between the controller 100, 300 and the other respective controller 300, 100 and various other components of the system 500, such as a remote server and user interface device, as discussed herein. For instance, the communications module 106, 306 may serve as an interface to permit the controller 100, 300 to transmit or receive wash control information and dry control information. Moreover, the communications module 106, 306 may include an interface 108, 308 (e.g., one or more analog-to-digital converters) to permit input signals to be converted into signals that can be understood and processed by the processor 102, 302.

Before, during, or after the washing machine appliance 50 operation and the dryer appliance 200 operation, the appliances may generally produce control information for one or more operating conditions. For example, control information regarding wash operating conditions may be generated by washing machine appliance 50, such as in some embodiments by, for example, user manipulation of the input selectors 60 or by sensor 110 data. Sensors 110 may be mass sensors, speed sensors, or other suitable sensors used in the washing machine appliance to obtain performance data for the washing machine appliance 50.

In certain embodiments, the wash control information may include a wash cycle, an article load type, an article load size, an occurrence end time, etc. Exemplary wash cycles include, for example, normal wash, spin only wash, rinse-and-spin wash, speed wash, heavy duty wash, whites wash, colors wash, bulky/bedding wash, delicates wash, or towel wash, as would be understood. Exemplary article load types include, for example, cotton articles, linen articles, silk articles, synthetic articles, or mixed articles, as would be understood. Article load size may be supplied by a user (e.g., as a relative size; such as small, medium, large, or extra-large) or sensed directly by a sensor (e.g., weight or mass sensor to measure the mass of a particular load, such as a wet load mass or a dry load mass). It should be understood that wash operating conditions and selected wash cycles, wash options, and performance data thereof are not limited to the above described examples, and rather that any suitable wash operating conditions and selected wash cycles, wash options, and performance data thereof are within the scope and spirit of the present disclosure.

Control information regarding the wash operating conditions may be stored by the controller 100. Further, the controller 100 may be operable to transmit the wash control information, such as to a remote server or second controller 300, as discussed herein. For example, the communications module 106 may be connected to a network as discussed herein. In some embodiments, wash control information for multiple occurrences (e.g., multiple loads of laundry articles, such as two or more washing operation occurrences or three or more washing operation occurrences) is recorded or stored. For instance, the wash control information of multiple (i.e., a plurality of) washing operation occurrences may be stored on controller 100, a remote server, or the second controller 300. The plurality of washing operation occurrences may be sequential (e.g., a first washing operation occurrence for a first load, a second washing operation occurrence for a second load following the first occurrence, a third washing operation occurrence for a third load following the second occurrence, etc.) and for loads all washed at the washing machine appliance 50 (e.g., one right after the other). Optionally, stored washing operation occurrences may be deleted or erased, such as in response to an explicit user command or a signal received from the controller 300.

The second controller 300 may be operable to receive the wash control information, such as from the remote server through the network as discussed herein. Additionally, the second controller 300 may be operable to store dry control information for one or more drying operations. For example, control information regarding drying operations may be generated by dryer appliance 200 or stored therein, such as in some embodiments by, for example, user manipulation of the input selectors 270 or by sensor 310 data. Sensors 310 may be mass sensors, speed sensors, or other suitable sensors used in the washing machine appliance to obtain performance data for the washing machine appliance 200.

In certain embodiments, the dry control information may include a dry cycle, an article load type, an article load size, a dry time, etc. Exemplary dry cycles include, for example, normal dry, permanent press dry, speed dry, heavy duty dry, whites dry, colors dry, bulky/bedding dry, delicates dry, or towel dry. Exemplary article load types include, for example, cotton articles, linen articles, silk articles, synthetic articles, or mixed articles, as would be understood. Article load size may be a relative size or measured value (e.g., in units of mass, such as a wet load mass or a dry load mass). It should be understood that dry operating conditions and selected dry cycles and dry options thereof are not limited to the above described examples, and rather that any suitable dry operating conditions and selected dry cycles and dry options thereof are within the scope and spirit of the present disclosure.

The second controller 300 may additionally be operable to set or adjust the dry control information based on the wash control information (e.g., of one or more washing operation occurrences, such as a load condition of a single washing operation occurrence or a combined load condition of a plurality of washing operation occurrences). For example, the controller 300 may automatically set the dry control information for a drying operation based on, and to correlate with, the wash control information. If the wash cycle is set to, for example, normal wash or delicate wash, the dry cycle may be automatically set by the second controller 300 to normal dry or delicate dry, respectively. A higher spin speed may correlate with a lower dry time. Load sizes may be correlated. Various other suitable settings of control information for a drying operation may be correlated to the control information for one or more washing operations, as desired, and the second controller 300 may automatically set the dry control information for these operating conditions.

In some embodiments, a combined load condition is determined for multiple discrete washing operation occurrences (i.e., a plurality of discrete washing operation occurrences). The exact number of occurrences of the plurality of discrete washing operation occurrences of the combined load condition may be set according to a predetermined number of recent washing operation occurrences (e.g., the last two or three washing operation occurrences) or according to a selection made by a user (e.g., two or more stored washing operation occurrences selected at dryer appliance 200).

Determining the combined load condition may include reconciling an element of wash control information (e.g., wash cycle or article load type) such that the combined load condition accounts for blending of two or more loads. Optionally, if an element of wash control information is identical in each of the washing operation occurrences, determining the combined load condition may include maintaining the identical element. Additionally or alternatively, if an element of wash control information differs between two or more of the washing operation occurrences, determining the combined load condition may include selecting a new element (i.e., an element that differs from the element of one or more of the washing operation occurrences). Such reconciliation may be made, for instance, according to a look-up table or chart stored within controller 100 or 300.

The combined load condition may, in turn, be used to indicate or adjust the dry control information that is appropriate for drying the laundry articles of all of the discrete washing operation occurrences at the same time. In other words, the combined load condition may be based on the wash control information of a plurality of discrete washing operation occurrences in order to dry multiple loads in a single drying operation occurrence. Thus, the second controller 300 may set or adjust the dry control information according to combined load condition.

As an example, multiple wash cycles (e.g., each corresponding to a separate washing operation occurrence) may be reconciled to select a combined wash cycle that most closely represents the multiple loads. If each of the multiple wash cycles are identical (e.g., two or three wash cycles are each a whites wash), the combined wash cycle may be the same as each of the multiple wash cycles (e.g., a whites wash). Thus, determining the combined load condition may include maintaining the identical wash cycle. By contrast, if one or more wash cycles are different from each other (e.g., one wash cycle is a whites wash and another wash cycle is a colors wash), the combined wash cycle may differ from one or more of the wash cycles (e.g., as a colors wash). Thus, determining the combined load condition may include selecting a new wash cycle in the combined wash cycle. Such reconciliations may be made, for instance, according to a look-up table or chart stored within the controller 100 or 300. An exemplary non-limiting portion of such a look-up table is illustrated below as Table 1:

TABLE 1

| Wash Cycle 1 | Wash Cycle 2 | Combined Wash Cycle |
|---|---|---|
| Whites wash | Colors wash | Colors wash |
| Bulky/bedding wash | Towel wash | Bulky/bedding wash |
| Colors wash | Colors wash | Colors wash |

As an additional or alternative example, multiple article load types (e.g., each corresponding to a separate washing operation occurrence) may be reconciled to select a combined article load type that most closely represents the multiple loads. If each of the multiple article load types are identical (e.g., two or three wash cycles are each a cotton articles type), the combined article load type may be the same as each of the multiple article load types (e.g., a cotton articles type). Thus, determining the combined load condition may include maintaining the identical article load type. By contrast, if one or more article load types are different from each other (e.g., one article load type is a cotton articles type and another article load type is a synthetic load type), the combined article load type may differ from one or more of the article load types (e.g., a synthetic load type). Thus, determining the combined load condition may include selecting a new article load type in the combined article load type. Such reconciliations may be made, for instance, according to a look-up table or chart stored within the controller 100 or 300. An exemplary non-limiting portion of such a look-up table is illustrated below as Table 2:

TABLE 2

| Article Load Type 1 | Article Load Type 2 | Combine Article Load Type |
|---|---|---|
| Cotton articles | Cotton articles | Cotton articles |
| Cotton articles | Synthetic articles | Mixed articles |
| Synthetic articles | Mixed articles | Mixed articles |

As another additional or alternative example, multiple article load sizes (e.g., each corresponding to a separate washing operation occurrence) may be combined for a combined load size (e.g., combined load mass). Thus, the combined load condition may include a combined load mass of the plurality of discrete washing operation occurrences. For instance, a dry load size (e.g., dry load mass) of a first washing operation occurrence may be added to a dry load size (e.g., dry load mass) of a second washing operation occurrence to produce a combined dry load size (e.g., combined dry load mass). Additionally or alternatively, a wet load size (e.g., wet load mass) of a first washing operation occurrence may be added to a wet load size (e.g., wet load mass) of a second washing operation occurrence to produce a combined wet load size (e.g., combined wet load mass).

As yet another additional or alternative example, a formula, chart, or look-up table may be stored within controller 100 or 300 to determine the effect on the moisture content of the articles of multiple washing operation occurrences based on the time at which one or more of the plurality of washing operation occurrences ended.

As still another another additional or alternative example, a formula, chart, or look-up table may be stored within controller 100 or 300 to determine the effect on an estimated drying time for the articles of multiple washing operation occurrences based on the combined load condition or time at which one or more of the plurality of washing operation occurrences ended. Optionally, an estimated drying time (e.g., time for completing a drying operation) may be updated according to the combined wash cycle, combined article type, or combined load mass.

Generally, the determination of the combined load condition may be performed by any suitable controller of system 500, such as at first controller 100 or second controller 300. Thus, first controller 100 may be configured to determine the combined load condition based on the wash control information of the plurality of discrete washing operation occurrences. Alternatively, second controller 300 may be configured to determine the combined load condition based on the wash control information of the plurality of discrete washing operation occurrences.

Optionally, the multiple washing operation occurrences used for the combined load condition may be deleted or erased following determination of the same. For instance, the controller 300 may be configured to transmit and erasure signal to the controller 100 in response to determination of the combined load condition or execution of the drying operation based on the combined load condition.

In optional embodiments, cleaning system 500 further includes a remote server 510. The remote server 510 may generally operate to receive and transmit control information related to the wash operating conditions or combined load conditions, and may thus be in communication with the washing machine appliance 50 and the dryer appliance 200. For example, remote server 510 may include one or more processor(s) 512 and associated memory device(s) 514 configured to perform a variety of computer-implemented functions (e.g., performing methods, steps, and the like). Additionally, the remote server 510 may also include a communications module 516 to facilitate communications between the remote server 510 and the other respective controllers 100, 300 and various other components of the system 500, such as a user interface device, as discussed herein. For instance, the communications module 516 may serve as an interface to permit the remote server 510 to transmit or receive wash control information and dry control information. Moreover, the communications module 516 may include an interface 518 (e.g., one or more analog-to-digital converters) to permit input signals to be converted into signals that can be understood and processed by the processor 512.

Server 510 is remote, and thus external to both the washing machine appliance 50 and the dryer appliance 200, as well as other components of the system 500 such as a user interface device, discussed herein. The server 510 may, for example, be in another room of a house or building in which the system 500 is used, or in a neighboring building, etc. Alternatively, and in exemplary embodiments, the remote server 510 is a cloud-based server 510, and is thus located at a distant location, such as in a separate state, country, etc. The remoter server 510 may be in wireless communication with the washing machine appliance 50 and the dryer appliance 200, such as through a network 520. The network 520 may be any type of wireless communications network, such as a local area network (e.g. intranet), wide area network (e.g. Internet), or some combination thereof. The network 520 can also include a direct connection between the client devices, such as the washing machine appliance 50, the dryer appliance 200, and a user interface device as discussed herein, and the server 510. In general, communication between the server 510 and the client devices may be carried via a network interface using any type of wireless connection, using a variety of communication protocols (e.g. TCP/IP, HTTP, SMTP, FTP), encodings or formats (e.g. HTML, XML), or protection schemes (e.g. VPN, secure HTTP, SSL). Accordingly, wash control information may be transmitted from the first controller 100 through the remote server 510 to the second controller 300 using the network 520.

System 500 may additionally include a user interface device 530. The user interface device 530 may be in wireless communication with the remote server 510, such as through the network 520 as discussed herein, and may thus indirectly be in wireless communication with the appliances 50, 200. The user interface device 530 may provide the user with access to the wash control information, dry control information, or combined load condition. Additionally or alternatively, user interface device 530 may be operable, such as by the user, to modify the wash control information. The user interface device 530 in exemplary embodiments is independent from the washing machine appliance 50 and the dryer appliance 200, and may in some embodiments be, for example, a computer (such as a desktop computer or a laptop), a tablet, a personal telephone (such as a suitable smartphone), or an independent device which functions solely to operate and communicate with the various other components of the cleaning system 500.

User interface device 530 may, include a controller 531. The controller 531 may include one or more processor(s) 532 and associated memory device(s) 534 configured to perform a variety of computer-implemented functions (e.g., performing methods, steps, and the like). Additionally, the controller 531 may also include a communications module 536 to facilitate communications between the device 530 and the server 510. For instance, the communications module 536 may serve as an interface to permit the controller 531 to transmit or receive wash control information and dry control information. Moreover, the communications module 536 may include an interface 538 (e.g., one or more analog-to-digital converters) to permit input signals to be converted into signals that can be understood and processed by the processor 532. The interface 538 may include or be in communication with input selectors 540 of the device 530, through which a user may provide various inputs are desired.

Accordingly, as discussed, wash control information for one or more wash operating conditions may be transmitted from the washing machine appliance 50, such as the controller 100 thereof, through the remote server 510 to the dryer appliance 200, such as the controller 300 thereof. The dry control information for one or more dry operating conditions may be adjusted based on the wash control information (e.g., according to the combined load conditions). This may, in turn, affect the particular dry cycle completed by the dryer appliance 200 or an estimated completion time for the corresponding drying operation occurrence. Advantageously, laundry system 500 may provide improved communication between appliances 10 and 200 while accommodating for multiple wash loads (i.e., multiple washing operation occurrence) within a single dry load (i.e., drying operation occurrence).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry system, comprising:

a washing machine appliance, the washing machine appliance comprising a first controller configured to initiate a washing operation, the first controller further being configured store wash control information of a plurality of discrete washing operation occurrences of the washing machine appliance; and a dryer appliance, the dryer appliance comprising a second controller in operable communication with the first controller to receive one or more data signals therefrom, the second controller configured to initiate a drying operation, wherein the first controller or the second controller is configured to determine a combined load condition based on the wash control information of the plurality of discrete washing operation occurrences of the washing machine appliance, and wherein the second controller is configured to adjust the drying operation according to the combined load condition.

2. The laundry system of claim 1, wherein the wash control information comprises a wash cycle of each washing operation occurrence of the plurality of discrete washing operation occurrences.

3. The laundry system of claim 1, wherein the wash control information comprises an article load type of each washing operation occurrence of the plurality of discrete washing operation occurrences.

4. The laundry system of claim 1, wherein the wash control information comprises an article load size of each washing operation occurrence of the plurality of discrete washing operation occurrences.

5. The laundry system of claim 1, wherein the wash control information comprises an occurrence end time of each washing operation occurrence of the plurality of discrete washing operation occurrences.

6. The laundry system of claim 1, wherein the plurality of discrete washing operation occurrences comprises three or more washing operation occurrences.

7. The laundry system of claim 1, wherein the first controller is configured to determine the combined load condition based on the wash control information of the plurality of discrete washing operation occurrences of the washing machine appliance.

8. The laundry system of claim 1, wherein the second controller is configured to determine the combined load condition based on the wash control information of the plurality of discrete washing operation occurrences of the washing machine appliance.

9. The laundry system of claim 1, wherein an element of wash control information is identical in each washing operation occurrence of the plurality of washing operation occurrences, and wherein determining the combined load condition comprises maintaining the identical element in the combined load condition.

10. The laundry system of claim 1, wherein an element of wash control information differs between two or more washing operation occurrences of the plurality of washing operation occurrences, and wherein determining the combined load condition comprises selecting a new element in the combined load condition.

11. A laundry system, comprising:

a washing machine appliance, the washing machine appliance comprising a first controller configured to initiate a washing operation, the first controller further being configured store wash control information of a plurality of discrete washing operation occurrences of the washing machine appliance, wherein the wash control information includes a wash cycle or an article load type of each washing operation occurrence of the plurality of discrete washing operation occurrences; and a dryer appliance, the dryer appliance comprising a second controller in operable communication with the first controller to receive one or more data signals therefrom, the second controller configured to initiate a drying operation, wherein the first controller or the second controller is configured to determine a combined load condition based on the wash control information of the plurality of discrete washing operation occurrences of the washing machine appliance, wherein the combined load condition comprises a combined mass of the plurality of discrete washing operation occurrences, and wherein the second controller is configured to adjust the drying operation according to the combined load condition.

12. The laundry system of claim 11, wherein the wash control information comprises the wash cycle of each washing operation occurrence of the plurality of discrete washing operation occurrences.

13. The laundry system of claim 11, wherein the wash control information comprises the article load type of each washing operation occurrence of the plurality of discrete washing operation occurrences.

14. The laundry system of claim 11, wherein the wash control information comprises an occurrence end time of each washing operation occurrence of the plurality of discrete washing operation occurrences.

15. The laundry system of claim 11, wherein the plurality of discrete washing operation occurrences comprises three or more washing operation occurrences.

16. The laundry system of claim 11, wherein the first controller is configured to determine the combined load condition based on the wash control information of the plurality of discrete washing operation occurrences of the washing machine appliance.

17. The laundry system of claim 11, wherein the second controller is configured to determine the combined load condition based on the wash control information of the plurality of discrete washing operation occurrences of the washing machine appliance.

18. The laundry system of claim 11, wherein an element of wash control information is identical in each washing operation occurrence of the plurality of washing operation occurrences, and wherein determining the combined load condition comprises maintaining the identical element in the combined load condition.

19. The laundry system of claim 11, wherein an element of wash control information differs between two or more washing operation occurrences of the plurality of washing operation occurrences, and wherein determining the combined load condition comprises selecting a new element in the combined load condition.

* * * * *